US007062063B2

(12) United States Patent
Hansen et al.

(10) Patent No.: US 7,062,063 B2
(45) Date of Patent: Jun. 13, 2006

(54) ELECTROACOUSTIC TRANSDUCER

(75) Inventors: Kaj Borge Hansen, Horsens (DK); Leif Johannsen, Odder (DK)

(73) Assignee: Sonion Horsens A/S, Horsens (DK)

( * ) Notice: Subject to any disclaimer, the term of this patent is extended or adjusted under 35 U.S.C. 154(b) by 378 days.

(21) Appl. No.: 10/057,848

(22) Filed: Jan. 25, 2002

(65) Prior Publication Data

US 2002/0114214 A1 Aug. 22, 2002

(30) Foreign Application Priority Data

Jan. 26, 2001 (DK) ..... 2001 00138

(51) Int. Cl.
*H04R 25/00* (2006.01)

(52) U.S. Cl. ..... 381/421; 381/152; 381/414; 381/431

(58) Field of Classification Search ..... 381/152, 381/396, 398, 399, 400, 402, 407, 409, 410, 381/412–414, 421, 423, 431
See application file for complete search history.

(56) References Cited

U.S. PATENT DOCUMENTS 1,934,184 A * 11/1933 Gerlach et al. ..... 381/431
4,544,805 A * 10/1985 Sawafuji ..... 381/410
6,285,773 B1 9/2001 Carme et al. ..... 381/418

FOREIGN PATENT DOCUMENTS

| | | |
|---|---|---|
| FR | 2 766 650 A1 | 1/1999 |
| JP | 56-137797 | 10/1981 |
| JP | 9-139997 | 5/1997 |
| JP | 11-205897 | 7/1999 |

OTHER PUBLICATIONS

EPO Search Report dated Jan. 15, 2002.

* cited by examiner

*Primary Examiner*—Suhan Ni
(74) *Attorney, Agent, or Firm*—Harness, Dickey & Pierce, P.L.C.

(57) ABSTRACT

An electroacoustic transducer includes a magnetic circuit of a magnetically conductive material with a pair of opposed surfaces defining a gap therebetween. The magnetic circuit includes a magnet inducing a magnetic field in the gap, the magnet having a surface constituting one of the opposed surfaces. The magnetic circuit further includes a diaphragm and a coil having electrically conducting paths secured to the diaphragm. The coil has portions of its paths situated in the gap.

15 Claims, 2 Drawing Sheets

ELECTROACOUSTIC TRANSDUCER

FIELD OF THE INVENTION

The present invention relates to electroacoustic transducers, and in particular to electrodynamic transducers with a diaphragm carrying a coil movable in a magnetic field.

BACKGROUND OF THE INVENTION

Electroacoustic transducers, and in particular electrodynamic transducers, are widely used in telecommunications equipment such as wired and mobile telephones, where small size is a requirement. Traditional electrodynamic microphones and speaker transducers used in e.g. mobile telephones are rotational symmetric and have a circular disc or ring shaped permanent magnet, which is magnetised in the axial direction of the magnet. A magnetic circuit of magnetically soft iron or other suitable material define a ring-shaped gap with a radially oriented magnetic field created by the magnet. A diaphragm carries a ring-shaped coil of electrically conducting wire situated in the gap.

If the inner and outer members defining the gap are not perfectly coaxial, the gap will not have a uniform width resulting in a distorted distribution of the magnetic field along the gap. A coil carrying electric currents at audio frequencies in such a distorted magnetic field will tend not to move in a linear movement but to tilt, which causes linear and non-linear distortion.

In such transducers the magnetic field in the ring-shaped gap is radially oriented, whereby the magnetic field is inherently stronger at its inner limit than at its outer limit. A not perfectly centred coil will cause the same distortion as mentioned above.

SUMMARY OF THE INVENTION

Such inhomogeneities in the magnetic field are avoided with the invention, whereby a cleaner output from the transducer is obtained, whether the transducer is a microphone or a speaker transducer. The magnetic field is stronger than in the known transducers, whereby the transducers can be made even smaller and still have the same sensitivity, which will be appreciated by the manufacturers of e.g. mobile telephones. Further, due to the magnetic circuit the transducer will have a reduced stray magnetic field relative to the traditional transducers.

BRIEF DESCRIPTION OF THE DRAWINGS

In the following the invention will be explained in detail with reference to the drawings, in which.

DETAILED DESCRIPTION OF THE PREFERRED EMBODIMENTS

Figure 1:
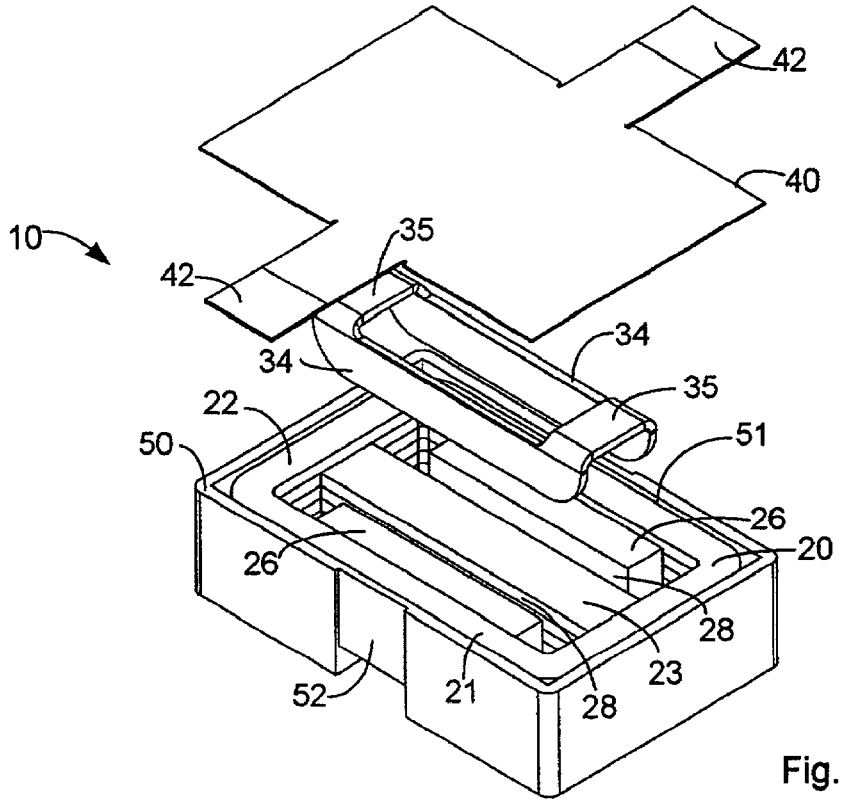
FIG. 1 is a perspective view showing a preferred embodiment of the invention with its essential parts exploded seen from above.
Figure 2:
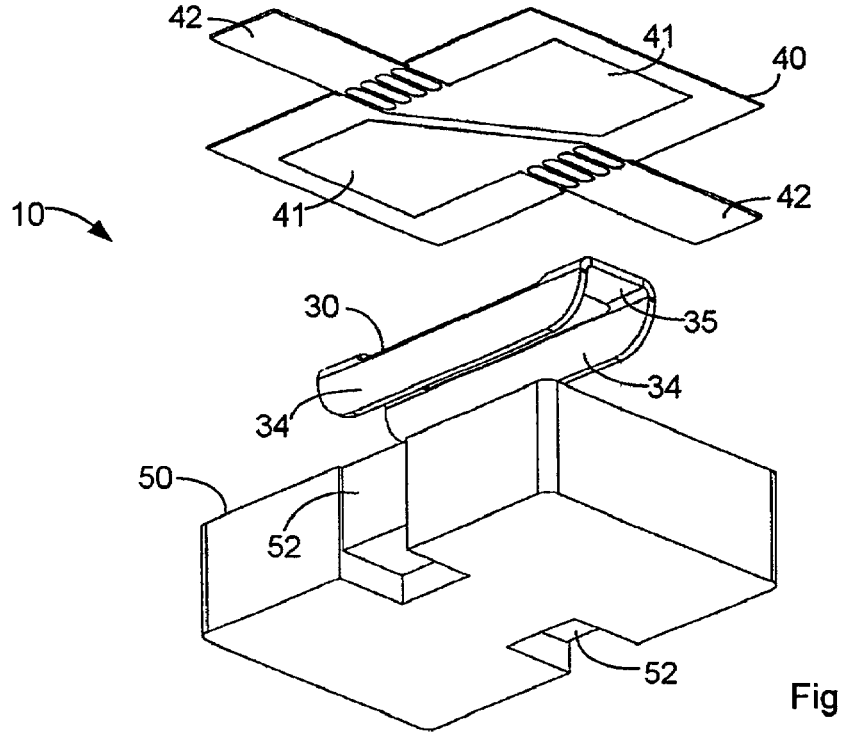
FIG. 2 shows the same parts in perspective seen from below.
Figure 3:
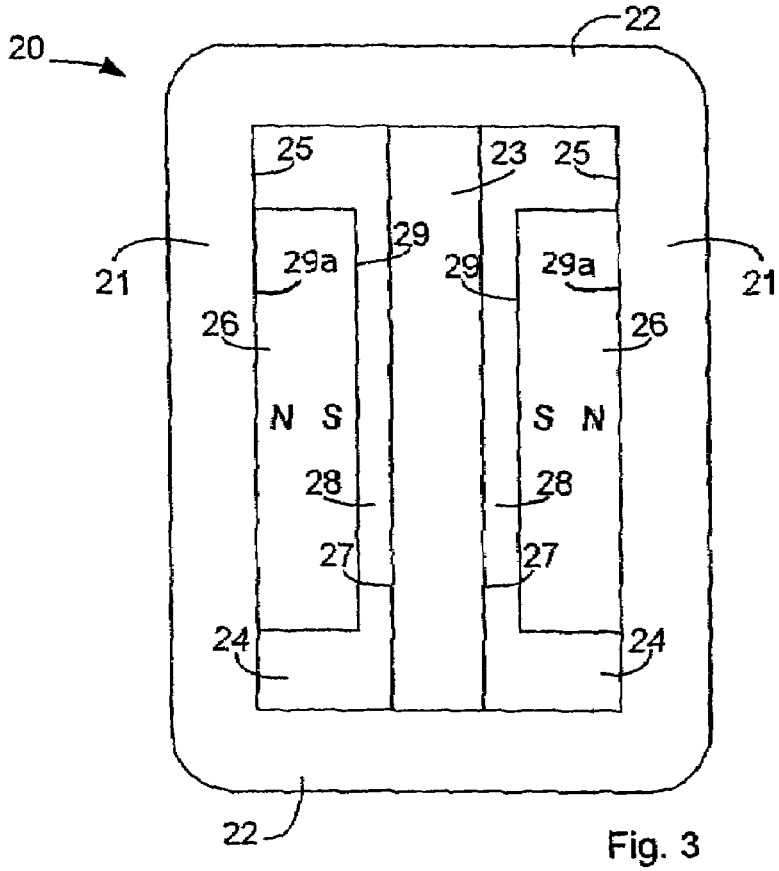
FIG. 3 shows the magnetic circuit of the transducer in FIGS. 1–2.

FIGS. 1 and 2 show an electrodynamic transducer 10 with its main components: a magnetic circuit 20, a coil 30 and a diaphragm 40. FIG. 3 also shows the magnetic circuit 20.

As is best seen in FIG. 3, the magnetic circuit 20 has two long legs 21 and two short legs 22 connected at their ends to form a ring of generally rectangular shape. A middle leg 23 interconnects the two short legs 22 dividing the internal of the rectangular ring into two rectangular openings 24. The two long legs 21, the two short legs 22 and the middle leg 23 of the magnetic circuit are of a magnetically soft material preferably having a high magnetic saturation value. The surfaces of the two long legs 21 and of the middle leg 23 facing towards the openings 24 are generally plane and define a gap therebetween. On the plane side 25 of each of the long legs 21 facing the opening 24 is a magnet 26 attached to the sides 25. The magnets 26 each have a magnetic pole surface attached to the long leg and the opposite free magnetic pole surface 29 facing the opening and the opposed plane surface 27 of the middle leg 23, whereby magnetic gaps 28 are defined between the free magnetic pole surfaces 29 and the surfaces 27 of the middle leg.

In an alternative embodiment (not shown), magnet 26 could be attached to the sides 27 of the middle leg 23. Thus, the magnets 26 each have a magnetic pole surface attached to the middle leg 23 and the opposite free magnetic pole surface 29*a* facing the opening and the opposed plane surface 25 of the long legs 21, whereby magnetic gaps (which in FIGS. 1 and 3 are denoted 28), instead of being positioned between the middle leg 23 and the magnets 26, are defined between the free magnetic pole surfaces 29*a* and the surfaces 25 of the long legs.

Each magnet 26 creates a magnetic field in the corresponding gap 28, and the magnetic return paths are defined through the middle leg 23, the short legs 22 and the long legs 21. The magnetic return paths thus completely encircle the magnetic gaps 28 with the magnets each having a magnetic pole surface defining a gap 28. This gives a very flat and compact structure of the magnetic system with the magnetic field concentrated in the gaps 28 and a low stray magnetic field, which results in a high sensitivity and less need for magnetic shielding. In FIGS. 1 and 2 the magnetic system 20 in FIG. 3 is situated in a plastic casing 50, e.g. by moulding or by fitting into a preformed "box". The plastic casing may have a bottom closing the openings 24 or leave them open.

Figure 4:
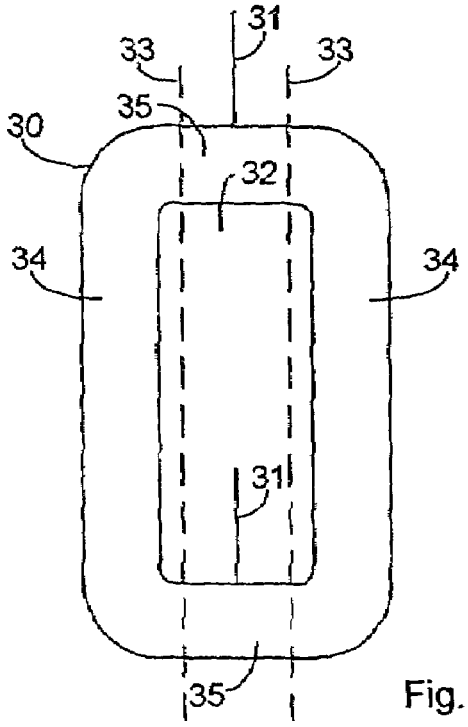
FIG. 4 shows a coil for use in the transducer of FIGS. 1–2, at an intermediate production stage.

FIG. 4 shows an embodiment of the coil 30 used in the transducer 10. The coil 30 is wound of electrically conducting thin wire such as copper and comprises a plurality of turns electrically insulated from each other, e.g. by means of a surface layer of lacquer. The coil has a coil axis perpendicular to the drawing. As is known in the art, the wire and the coil is heated during winding, whereby the lacquer becomes adhesive and adheres the windings to each other and thereby stabilises the coil mechanically. The wire of the coil 30 has two wire ends 31 for connecting the coil electrically to e.g. electronic circuits.

The coil 30 is wound on a mandrel of generally rectangular cross section, whereby the coil is given the shape shown in FIG. 4 with a generally rectangular opening 32 and a generally rectangular outer contour with rounded corners. In FIG. 4 the coil is relatively flat and has a thickness, which is less than its radial width between its inner and outer contours—typically 10–30% of the radial width or according to the subsequent operations to be performed on the coil.

After the coil has been wound with the desired number of turns of wire and to the desired shape and thickness it is removed from the mandrel. While the coil is still warm, and the lacquer is still soft due to the elevated temperature, the coil is bent along two parallel bending axes 33 in the plane of the flat coil using a (not shown) bending instrument. The coil is hereby given the shape shown in FIGS. 1 and 2, where the two long sections 34 of the coil have been bent 90 degrees relative to the two short sections 35, and the two long sections 34 are now parallel to each other. After the bending the coil is allowed to cool so that the lacquer is no longer flexible, and the coil stabilises.

In an alternative embodiment, the coil may be formed by a thin and flexible sheet, such as a flexible printed circuit board, i.e. a flexprint. Such thin and flexible sheet will carry a predefined electrically conductive path thereon so as to form a coil-like electrical path. As explained later, the diaphragm will also in its preferred embodiment have electrically conductive portions. Therefore, the coil and diaphragm can be made from a single sheet of flexprint with appropriate conductive paths, and this sheet will be shaped in such a way that the two long sections of the coil will emerge and have an angle of 90 degrees with respect to the rest of the integrated diaphragm/coil structure.

The bent and stabilised coil is then secured to the diaphragm 40. The diaphragm is made from a thin and flexible sheet. On its lower side, which is the side shown in FIG. 2, the diaphragm 40 has electrically conductive portions 41, and the two short sections 35 of the coil are secured to the lower side of the diaphragm, e.g. by means of an adhesive, with the two wire ends 31 electrically connected to respective ones of the electrically conductive portions 41, e.g. by soldering or welding. The fact that the wire ends are connected directly to the diaphragm significantly reduces the risk of breaking/damaging the wires when the transducer is operated, i.e. the diaphragm is moved, since the coil is secures to the diaphragm 40.

However, the wire ends may alternatively be electrically connected to terminals on the casing, e.g. by soldering.

The diaphragm 40 is rectangular in shape, and tongues 42 extend from the long sides of the diaphragm with the electrically conductive portions 41 extending to the tongues, so that the electrically conductive portions 41 on the tongues are electrically connected to respective ones of the coil wire ends 31.

The diaphragm 40 with the coil 30 thus secured thereto is then mounted on the magnetic system 20 with the two long sections 34 of the coil in respective ones of the gaps 28. The long sections 34 are therefore also referred to as gap portions of the coil. The two short sections 35 of the coil will be situated over the middle leg 23 and will bridge the two gap portions of the coil. The diaphragm will be secured to the magnetic system along its long edges. The diaphragm has a width corresponding to the distance between the inner sides of the edges 51 of the casing. If desired, the long edges of the diaphragm may be secured to the magnetic system by means of an adhesive. The short sides of the diaphragm are preferably free, whereby a narrow slot is provided giving access of air between the two sides of the diaphragm. The slot can be tuned to have desired acoustic properties influencing the acoustic performance of the transducer, in particular at low frequencies.

If desired, the short edges of the diaphragm can also be secured to the magnetic system or to the casing, or, alternatively, the slot can be closed with a flexible substance so as to allow the short edges to move. However, the flexible substrate prevents air from going from one side of the diaphragm to the other.

In the preferred embodiment the diaphragm is rectangular, but other shapes can be used.

In FIG. 1 it is seen that the magnetic circuit is laminated from several layers, and that the uppermost layer the middle leg 23 the is omitted, so that the uppermost layer has the shape of the generally rectangular ring with two long legs and two short legs. The "missing" part of the middle leg gives room for accommodating the bridging portions 35 of the coil. However, the "missing" is not imperative—other arrangements for generating the necessary room for the bridging portions 35 of the coil are available, such as providing indentations (typically two) in the middle leg 23.

The magnetic circuit may also be made as one solid block or as an outer ring with the middle leg inserted therein.

FIGS. 1 and 2 also show that, on its sides, the plastic casing 50 has two grooves or channels 52 ending on the bottom of the casing 50. The channels 52 have a width corresponding the width of the tongues 42. The tongues 42 will be bent and received in respective ones of the channels 52 with the ends of the tongues received in the part of the grooves at the bottom of the casing 50. The ends of the tongues will be bent 180 degrees so that the end of the conductive portion becomes exposed, or a through-plated hole will establish electrical connection through the tongue. The end portions of the conductive portions of the tongues will thus act as the electrical terminals of the transducer.

Alternatively, the end portions of the conductive portions of the tongues can be soldered to electrical terminals mounted in the grooves 52 of the plastic housing 50.

The transducer will preferably have a front cover with openings in front of the diaphragm. The transducer may be used as a microphone or as a speaker transducer in telecommunications equipment such as mobile telephones.

The rectangular diaphragm is retained along two opposed edges, preferably the long edges and free at the two other edges. Hereby a simple bending motion of the diaphragm is obtained, and in comparison to transducers having their diaphragm retained along the entire periphery the transducer of the invention will have a relatively high sensitivity even with a relatively thick diaphragm.

The transducer is equally suitable as a speaker transducer and as a microphone. When used as a speaker transducer, electrical signals at audio frequencies are supplied to the terminals, and the resulting current in the gap portions of the coil wire will interact with the magnetic field in the gaps and cause the coil and the diaphragm to move and generate sound at the audio frequencies. Likewise when used as a microphone, sound at audio frequencies acting on the diaphragm will cause it to move, and when the gap portions of the coil wire move in the magnetic field electrical signals will be generated and output on the terminals of the transducer.

In the preferred embodiment the magnetic circuit is rectangular, and there are two gaps receiving the gap portions of the coils, where the gaps are defined between opposed plane surfaces. In another configuration the magnetic circuit could have four gaps arranged like the sides of a square, and the coil would then correspondingly have four gap portions likewise arranged like the sides of a square. The bridging portions of the coil would then be at the corners of the square and be secured to the diaphragm at four locations. The outer contour of the magnetic circuit can have any desired shape including circular shape. Also, the gaps and the gap portions of the coils can be curved as arcs of a circle.

The invention claimed is:

1. An electroacoustic transducer comprising a magnetic circuit of a magnetically conductive material with a pair of opposed surfaces defining a gap therebetween, the magnetic circuit comprising a magnet inducing a magnetic field in the gap, the magnet having a surface constituting one of the opposed surfaces, a substantially plane diaphragm, and a coil having electrically conducting paths secured to the substantially plane diaphragm, the coil having portions of its paths situated in the gap, wherein the magnetically conductive material defines magnetic return paths between the pair of opposed surfaces, said magnetic return paths extending in a plane being substantially parallel to the substantially plane diaphragm.

2. A transducer according to claim 1, wherein the magnetic circuit has two pairs of opposed surfaces defining first and second gaps, and wherein the coil has first and second gap portions of its paths situated in respective ones of the first and second gaps, and bridging portions of paths interconnecting the first and second gap portions of paths, the coil being secured to the substantially plane diaphragm at the bridging portions.

3. A transducer according to claim 2, wherein each pair of opposed surfaces are substantially plane surfaces being substantially parallel to each other.

4. A transducer according to claim 2 wherein the magnetic circuit comprises a body of magnetically soft material with two openings therein.

5. A transducer according to claim 4, wherein magnets are positioned in the openings, and wherein the magnets are attached to outer legs of the body of magnetically soft material so as to form gaps between surfaces of an inner leg of the body of magnetically soft material and surfaces of the magnets.

6. A transducer according to claim 4 wherein magnets are positioned in the openings, and wherein the magnets are attached to an inner leg of the body of magnetically soft material so as to form gaps between surfaces of outer legs of the body of magnetically soft material and surfaces of the magnets.

7. A transducer according to claim 4, wherein the openings in the magnetic circuit are through-going.

8. A transducer according to claim 2 wherein the bridging portions define a bridging plane having a substantially flat surface for securing the coil to the substantially plane diaphragm, and wherein each of the gap portions comprises a plurality of electrically conducting segments being substantially parallel to the bridging plane.

9. A transducer according to claim 8 wherein the electrically conducting segments in the gap portions are substantially linear.

10. A transducer according to claim 1 wherein the coil is formed by a wounded electrically conducting wire.

11. A transducer according to claim 1, wherein the coil is formed by electrically conducting paths formed on a flexible circuit board.

12. A transducer according to claim 1 further comprising a casing for housing the magnetic circuit, the casing comprising a rectangular-shaped opening being defined by two pairs of edges, the substantially plane diaphragm being attached to the casing in a manner so as to at least partly cover the rectangular-shaped opening.

13. A transducer according to claim 12 wherein the substantially plane diaphragm has a rectangular shape so as to cover the rectangular-shaped opening of the casing.

14. A transducer according to claim 12, wherein the substantially plane diaphragm is attached to one of the two pairs of edges of the casing.

15. A transducer according to claim 12, wherein the substantially plane diaphragm is attached to both pairs of edges of the casing.

* * * * *